US006187176B1

(12) United States Patent
Hantzer et al.

(10) Patent No.: US 6,187,176 B1
(45) Date of Patent: Feb. 13, 2001

(54) PROCESS FOR THE PRODUCTION OF MEDICINAL WHITE OIL

(75) Inventors: Sylvain Hantzer, Prairleville; Alberto Ravella, Baton Rouge; Ian A. Cody, Baton Rouge; Darryl P. Klein, Baton Rouge, all of LA (US)

(73) Assignee: Exxon Research and Engineering Company, Florham Park, NJ (US)

( * ) Notice: Under 35 U.S.C. 154(b), the term of this patent shall be extended for 0 days.

(21) Appl. No.: 08/917,652

(22) Filed: Aug. 22, 1997

(51) Int. Cl.[7] ..... C10G 17/06

(52) U.S. Cl. ..... 208/268; 208/143; 208/57; 208/97; 208/144; 208/151; 208/264

(58) Field of Search ..... 208/213, 143, 208/268, 57, 97, 151, 144, 264

(56) References Cited

U.S. PATENT DOCUMENTS 4,055,481 * 10/1977 Kidwell ..... 208/89
4,251,347 * 2/1981 Rausch ..... 208/57
4,263,127 * 4/1981 Rausch et al. ..... 208/58
5,198,099 * 3/1993 Trasche et al. ..... 208/89
5,518,607 * 5/1996 Field et al. ..... 208/65

* cited by examiner

*Primary Examiner*—Helane Myers
(74) *Attorney, Agent, or Firm*—Henry E. Naylor; Gerard J. Hughes

(57) ABSTRACT

A three stage process for producing high quality white oils, particularly food grade mineral oils from mineral oil distillates. The first reaction stage preferably employs a sulfur resistant hydrotreating catalyst and produces a product suitable for use as a high quality lubricating oil base stock. The second reaction stage preferably employs a hydrogenation/hydrodesulfurization catalyst combined with a sulfur sorbent and produces a product stream which is low in aromatics and which has substantially "nil" sulfur. The final reaction stage employs a selective hydrogenation catalyst that produces a product suitable as a food grade white oil.

17 Claims, No Drawings

PROCESS FOR THE PRODUCTION OF MEDICINAL WHITE OIL

FIELD OF THE INVENTION

This invention relates to a three stage process for producing high quality white oils, particularly food grade mineral oils from mineral oil distillates. The first reaction stage preferably employs a sulfur resistant hydrotreating catalyst and produces a product suitable for use as a high quality lubricating oil base stock. The second reaction stage preferably employs a hydrogenation/hydrodesulfurization catalyst combined with a sulfur sorbent and produces a product stream which is low in aromatics and which has substantially "nil" sulfur. The final reaction stage employs a selective hydrogenation catalyst that produces a product suitable as a food grade white oil.

BACKGROUND OF THE INVENTION

White mineral oils, called white oils, are colorless, transparent, oily liquids obtained by the refining of crude petroleum feedstocks. In the production of white oils, an appropriate petroleum feedstock is refined to eliminate, as completely as possible, oxygen, nitrogen, and sulfur compounds, reactive hydrocarbons including aromatics, and any other impurity which would prevent use of the resulting white oil in the pharmaceutical or food industry. White oils generally fall into two classes, technical grade and pharmaceutical grade. Technical grade white oils are those suitable for use in cosmetics, textile lubrication, bases for insecticides, and the like. The more highly refined pharmaceutical grade white oils are those suitable for use in drug compositions, foods, and for the lubrication of food handling machinery. The pharmaceutical grade white oils must be chemically inert and substantially without color, odor, or taste. Also, for these applications manufacturers must remove "readily carbonizable substances" (RCS) from the white oil. RCS are impurities which cause the white oil to change color when treated with strong acid. The FDA and white oil manufacturers have stringent standards with respect to RCS which must be met before the white oil can be marketed for use in food or pharmaceutical applications. In particular, 21 C.F.R. §172.878 (1988) defines white mineral oil as a mixture of liquid hydrocarbons, essentially paraffinic in nature obtained from petroleum and refined to meet the test requirements of the *United States Pharmacopoeia XX*, pp. 532 (1980) for readily carbonizable substances and for sulfur compounds. The Ultraviolet Absorption Test generally measures the ultraviolet absorbance of an extract in the range of 260–350 nm, which absorbance is then compared with that of a naphthalene standard. This test sets forth limits for the presence of polynuclear compound impurities in the white oil.

White oil must also pass the Hot Acid Carbonizable Substances Test (ASTM D-565) to conform to the standard of quality required for pharmaceutical use. In order to pass this test the oil layer must show no change in color and the acid level is not darker than that of the reference standard colorimetric solution. From this test it will be seen that for purposes of interpreting test results, the art has recognized that a value of 16 or below on the Hellige Amber C Color Wheel is sufficient to pass the carbonizable substances test.

The present invention is primarily concerned with the production of pharmaceutical grade white oils. There are numerous processes in the prior art for the production of white oils of both grades. In general, the first step in the production of white oil is the removal of lighter fractions, such as gasoline, naphtha, kerosene, and gaseous fractions, from the feedstock by fractional distillation. In early processes, white oil was refined by treatment with sulfuric acid to remove unsaturated aromatic and unstable hydroaromatic compounds which comprised most of the impurities present in the oil. Typically, the acid treated oil was subjected to adsorption refining to remove such impurities as carbon, coke, asphaltic substances, coloring matter and the like.

Conventional methods of making white oils with sulfuric acid however, have been subject to objection in recent years since acid treating is costly and gives rise to undesirable amounts of sludge. Because of objections to sulfuric acid treatments, other procedures were developed for the production of white oils from hydrocarbon feedstocks. Representative processes of these procedures can be found in U.S. Pat. Nos. 3,392,112; 3,459,656; 4,055,481; 4,251,347; 4,263,127; and 4,325,804, which are incorporated herein by reference. Further, U.S. Pat. No. 4,786,402, which is also incorporated herein by reference, teaches a two-step catalytic hydrogenation process. The catalyst used in the first step is a sulfur resistant, non-precious metal having both a hydrotreating (especially hydrodesulfurization) and a hydrogenation function. The metal of the catalyst will typically be selected from tin, vanadium, chromium, molybdenum, tungsten, iron, cobalt, nickel and mixtures thereof. The metal is present in a catalytically effective amount, for example, about 2 to 30 weight percent. The catalyst exists as the free metal, or in the form of an oxide or sulfide. Hydrogenation to a medicinal grade white oil is achieved in the second step of the process over a reduced nickel-containing catalyst, which is extremely sensitive to trace sulfur.

Hydrodesulfurization is one of the fundamental processes of the refining and chemical industries. The removal of feed sulfur by conversion to hydrogen sulfide is typically achieved by reaction with hydrogen over non-noble metal sulfides, especially those of Co/Mo and Ni/Mo. The reaction is performed at fairly severe conditions of temperatures and pressures in order to meet product quality specifications, or to supply a desulfurized stream to a subsequent sulfur sensitive process. The latter is a particularly important objective because some processes are carried out over catalysts which are extremely sensitive to poisoning by sulfur. This sulfur sensitivity is sometimes sufficiently acute as to require a substantially sulfur free feed. In other cases environmental considerations and mandates drive product quality specifications to very low sulfur levels.

There is a well established hierarchy in the ease of sulfur removal from the various organosulfur compounds common to refinery and chemical streams. Simple aliphatic, naphthenic, and aromatic mercaptans, sulfides, di- and polysulfides and the like surrender their sulfur more readily than the class of heterocyclic sulfur compounds comprised of thiophene and its higher homologs and analogs. Desulfurization reactivity decreases with increasing molecular structure and complexity within the generic thiophenic class. For example, the simple thiophenes are the more labile, or "easy" sulfur types. The other extreme, which is sometimes referred to as "hard sulfur" or "refractory sulfur," is represented by the derivatives of dibenzothiophene, especially those mono- and di-substituted and condensed ring dibenzothiophenes bearing substituents on the carbons beta to the sulfur atom. These highly refractory sulfur heterocycles resist desulfurization as a consequence of steric inhibition precluding the requisite catalyst-substrate interaction. For this reason, these materials survive traditional desulfurization and they poison subsequent processes whose operability is dependent upon a sulfur sensitive catalyst. Destruction of these "hard sulfur" types can be accomplished under relatively severe high pressure process conditions, but this may prove to be economically undesirable owing to the onset of undesirable side reactions. Also, the level of investment and operating costs required to drive the severe process conditions may be too great for the required sulfur specification.

A recent review (M. J. Girgis and B. C. Gates, *Ind. Eng. Chem.*, 1991, 30, 2021) addresses the fate of various thiophenic types at reaction conditions employed industrially, e.g., 340–425 C. (644–799 F.), 825–2550 psig. The substitution of a methyl group into the 4- position or into the 4- and 6-positions decreases the desulfurization activity by an order of magnitude for dibenzothiophenes. These authors state, "These methyl-substituted dibenzothiophenes are now recognized as the organosulfur compounds that are most slowly converted in the HDS of heavy fossil fuels. One of the challenges for future technology is to find catalysts and processes to desulfurize them."M. Houalla et al., *J. Catal.*, 61, 523 (1980) disclose activity debits of 1 to 10 orders of magnitude for similarly substituted dibenzothiophenes under similar hydrodesulfurization conditions. While the literature addresses methyl substituted dibenzothiophenes, it is apparent that substitution with alkyl substituents greater than methyl, e.g., 4, 6-diethyldibenzothiophene, would intensify the refractory nature of these sulfur compounds. Condensed ring aromatic substituents incorporating the 3,4 and/or 6,7 carbons would exert a similar negative influence. Similar results are described by Lamure-Meille et al., Applied Catalysis A: General, 131, 143, (1995) based on similar substrates.

Mochida in et al., Catalysis Today, 29, 185 (1996) address the deep desulfurization of diesel fuels from the perspective of process and catalyst designs aimed at the conversion of the refractory sulfur types, which "are hardly desulfurized in the conventional HDS process." These authors optimize their process to a product sulfur level of 0.016 wt. %, which reflects the inability of an idealized system to drive the conversion of the most resistant sulfur molecules to extinction. Vasudevan et al., Catalysis Reviews, 38, 161(1996) in a discussion of deep HDS catalysis, report that while Pt and Ir catalysts were initially highly active on refractory sulfur species, both catalysts deactivated with time on oil.

In light of the above, there is still a need for a desulfurization process that can convert feeds bearing the refractory, condensed ring sulfur heterocycles at relatively mild process conditions to products containing substantially no sulfur.

SUMMARY OF THE INVENTION

In accordance with the present invention there is provided a process for the preparation of pharmaceutical grade white oils from a mineral hydrocarbon oil feedstock having a viscosity ranging from about 60 to about 600 SUS at 37.8° C., by a three stage catalytic process, which process comprises: (a) hydrotreating said mineral oil feedstock in a first reaction stage containing a hydrotreating catalyst and a hydrogen-containing treat gas, which first reaction stage is operated under hydrotreating conditions, thereby resulting in a said feedstock being at least partially hydrogenated and desulfurized; (b) hydrotreating the reaction product of said first reaction stage in a second reaction stage in the presence of: (i) a hydrodesulfurization catalyst comprised of a Group VIII metal on an inorganic support, (ii) a hydrogen-containing treat gas, and (iii) a hydrogen sulfide sorbent material, wherein said second reaction stage is operated at temperatures from about 40° C. to 500° C. and pressures from about 100 to 3,000 psig; and (c) hydrogenating the reaction product from said second reaction stage in a third reaction stage in the presence of a nickel based catalyst, thereby producing a white oil having a hot acid number of less than about 16 on the Hellige Amber C Color Wheel and an ultraviolet absorbance value of less than 0.1.

In a preferred embodiment of the present invention, the Group VIII metal is a noble metal selected from Pt, Pd, Ir, and mixtures thereof.

In still another preferred embodiment of the present invention the initial feedstock is a solvent extracted lubricating oil having a viscosity ranging from about 70 to 500 SUS at 37.8° C.

In another preferred embodiment of the present invention, the hydrogen sulfide sorbent is selected from supported and unsupported metal oxides, spinels, zeolitic based materials, and layered double hydroxides.

DETAILED DESCRIPTION OF THE INVENTION

The process of the present invention is applicable to removing sulfur from all sulfur bearing mineral hydrocarbon oil feedstocks. The process is particularly suitable for the desulfurization of the least reactive, most highly refractory sulfur species, especially the class derived from dibenzothiophenes, and most especially the alkyl, aryl, and condensed ring derivatives of this heterocyclic group, particularly those bearing one or more substituents in the 3-, 4-, 6-, and 7-positions relative to the thiophenic sulfur. The process of the present invention will result in a product stream having substantially no sulfur. For purposes of this invention, the term, "substantially no sulfur", depends upon the overall process being considered, but can be defined as a value less than about 0.1 wppm, preferably less than about 0.5 wppm, more preferably less than about 0.1 wppm, and most preferably less than about 0.01 wppm as measured by existing, conventional analytical technology.

The initial feedstocks suitable for use in the practice of the present invention are any petroleum hydrocarbon fraction capable of yielding a product of the desired purity range by treatment in accordance with the process steps of the present invention. When the desired final product of the present invention is a white mineral oil, or other oil in the lubricating range of viscosities, the charge to the first stage is preferably a light or medium lubricating distillate which generally has viscosities ranging from about 70 SUS to 500 SUS at 38.8° C. For pharmaceutical grade white oil production, the charge stock is preferably a raffinate resulting from solvent treatment of a light or medium neutral distillate oil with a selective solvent, i.e., a distillate fraction which has been extracted. For the production of technical grade white oils, a non-solvent extracted distillate oil may be used as the starting material. When the final product is charcoal lighter fluid, the charge stock can comprise alkylate bottoms such as materials obtained from sulfuric acid or hydrogen fluoride alkylation processes boiling above the gasoline range. When the final product is petrolatum, the chargestock can be paraffin slack wax, microcrystalline waxes, oils and the like. For producing pharmaceutical waxes, paraffin wax obtained by solvent dewaxing of a waxy lubrication distillate is suitable.

Catalysts suitable for use in the present invention are those comprised of a noble or non-noble metal, or metals, of Group VIII of the Periodic Table of the Elements supported in a highly dispersed and substantially uniformly distributed manner on a refractory inorganic support. One class of catalysts that can serve as the hydrodesulfurization catalyst for the present invention is that class of catalysts which is normally employed for purposes of catalytic reforming. Such catalysts include both mono- and polymetallic catalysts common to the reforming art. Various promoter metals may also be incorporated for purposes of selectivity, activity, and stability improvement.

Group VIII noble metals that may be used for the hydrodesulfurization catalysts of the present invention include Pt, Pd, and Ir; preferably Pt, Pd. Preferred bimetallic noble metal catalysts include Pt-Ir, Pd-Ir, and Pt-Pd; Pt-Ir and Pt-Pd are more preferred. These mono- and bimetallic noble metal catalysts may contain a promoter metal, preferably selected from Re, Cu, Ag, Au, Sn, Zn, and the like, for stability and selectivity improvement. Preferred Group VIII non-noble metals are Fe, Co and Ni, more preferably Ni.

Suitable support materials for the catalysts and hydrogen sulfide sorbents of the present invention include inorganic, refractory materials such as alumina, silica, silicon carbide, amorphous and crystalline silica-aluminas, silica-magnesias, aluminophosphates boria, titania, zirconia, and mixtures and cogels thereof. Preferred supports include alumina and the crystalline silica-aluminas, particularly those materials classified as clays or zeolites, and more preferably controlled acidity zeolites, including aluminophosphates, and modified by their manner of synthesis, by the incorporation of acidity moderators, and post-synthesis modifications such as demetallation and silylation. For purposes of this invention particularly desirable zeolitic materials are those crystalline materials having micropores and include conventional zeolitic materials and molecular sieves, including aluminophosphates and suitable derivatives thereof. Such materials also include pillared clays and layered double hydroxides.

The metals may be loaded onto these supports by conventional techniques known in the art. Such techniques include impregnation by incipient wetness, by adsorption from excess impregnating medium, and by ion exchange. The metal bearing catalysts of the present invention are typically dried, calcined, and reduced; the latter may either be conducted ex situ or in situ as preferred. The catalysts need not be presulfided because the presence of sulfur is not essential to hydrodesulfurization activity and activity maintenance. However, the sulfided form of the catalyst may be employed without harm and in some cases may be preferred if the absence of catalyst sulfur contributes to the loss of selectivity or to decreased stability. If sulfiding is desired, then it can be accomplished by exposure to dilute hydrogen sulfide in hydrogen or by exposure to a sulfur containing hydrocarbon feed until sulfur breakthrough is detected.

Total metal loading for catalysts of the present invention is in the range of about 0.01 to 5 wt. %, preferably about 0.1 to 2 wt. %, and more preferably about 0.15 to 1.5 wt. %. For bimetallic noble metal catalysts similar ranges are applicable to each component; however, the bimetallics may be either balanced or unbalanced where the loadings of the individual metals may either be equivalent, or the loading of one metal may be greater or less than that of its partner. The loading of stability and selectivity modifiers ranges from about 0.01 to 2 wt. %, preferably about 0.02 to 1.5 wt. %, and more preferably about 0.03 to 1.0 wt. Chloride levels range from about 0.3 to 2.0 wt. %, preferably about 0.5 to 1.5 wt. %, and more preferably about 0.6 to 1.2 wt. %. Sulfur loadings of the noble metal catalysts approximate those produced by breakthrough sulfiding of the catalyst and range from about 0.01 to 1.2 wt. %, preferably about 0.02 to 1.0 wt. %.

The hydrogen sulfide sorbent of this invention may be selected from several classes of material known to be reactive toward hydrogen sulfide and capable of binding same in either a reversible or irreversible manner. Metal oxides are useful in this capacity and may be employed as the bulk oxides or may be supported on an appropriate support material such as an alumina, silica, or a zeolite, or mixtures thereof Representative metal oxides include those of the metals from Groups IA, IIA, IB, IIB, IIIA, IVA, VB, VIB, VIIB, VIII of the Periodic Table of the Elements. Representative elements include Zn, Fe, Ni, Cu, Mo, Co, Mg, Mn, W, K, Na, Ca, Ba, La, V, Ta, Nb, Re, Zr, Cr, Ag, Sn, and the like. The metal oxides may be employed individually or in combination. The preferred metal oxides are those of Ba, K, Ca, Zn, Co, Ni, and Cu. Representative supported metal oxides include ZnO on alumina, CuO on silica, ZnO/CuO on kieselguhr, and the like. Compounds of the Group IA and IIA metals capable of functioning as hydrogen sulfide sorbents include, in addition to the oxides, the hydroxides, alkoxides, and sulfides. These systems are disclosed in the following patents of Baird et al. incorporated herein by reference: U.S. Pat. No. 4,003,823; U.S. Pat. No. 4,007,109; U.S. Pat. No. 4,087,348; U.S. Pat. No. 4,087,349; U.S. Pat. No. 4,119,528; U.S. Pat. No. 4,127,470.

Spinels represent another class of hydrogen sulfide sorbents useful in this invention. These materials are readily synthesized from the appropriate metal salt, frequently a sulfate, and sodium aluminate under the influence of a third agent like sulfuric acid. Spinels of the transition metals listed above may be utilized as effective, regenerable hydrogen sulfide sorbents; zinc aluminum spinel, as defined in U.S. Pat. No. 4,263,020, incorporated herein by reference, is a preferred spinel for this invention. The sulfur capacity of spinels may be promoted through the addition of one or more additional metals such as Fe or Cu as outlined in U.S. Pat. No. 4,690,806, which is incorporated herein by reference.

Zeolitic materials may serve as hydrogen sulfide sorbents for this invention as detailed in U.S. Pat. No. 4,831,206 and U.S. Pat. No. 4,831,207, which is incorporated herein by reference. These materials share with spinels the ability to function as regenerable hydrogen sulfide sorbents and permit operation of this invention in a mode cycling between sulfur capture and sulfur release in either continuous or batch operation depending upon the process configuration. Zeolitic materials incorporating sulfur active metals by ion exchange are also of value to this invention. Examples include Zn4A, chabazite, and faujasite moderated by the incorporation of zinc phosphate, and transition metal framework substituted zeolites similar to, but not limited to, U.S. Pat. Nos. 5,185,135; 5,185,136; and U.S. Pat. No. 5,185,137 and U.S. Pat. No. 5,283,047, and continuations thereof, all incorporated herein by reference.

Various derivatives of hydrotalcite (often referred to as LDH, layered double hydroxides) exhibit high sulfur capacities and for this reason serve as hydrogen sulfide sorbents for this invention. Specific examples include $Mg_{4.8}Al_{1.2}(OH)_{12}Cl_{1.2}$, $Zn_4Cr_2(OH)_{12}Cl_2$, $Zn_4Al_2(OH)_{12}Cl_2$, $Mg_{4.5}Al_{1.5}(HO)_{12}Cl_{1.5}$, $Zn_4Fe_2(OH)_{12}Cl_2$, and $Mg_4Al_2(OH)_{12}Cl_3$ and may include numerous modified and unmodified synthetic and mineral analogs of these as described in U.S. Pat. Nos. 3,539,306, 3,796,792, 3,879,523, and 4,454,244, and reviewed by Cavani et al. in Catalysis Today, Vol. 11, No. 2, pp. 173–301 ($^{1}$991), all of which are incorporated herein by reference. Particularly active hydrogen sulfide sorbents are LaRoach H-T, $ZnSi_2O_5$ gel, $Zn_4Fe_2(OH)_{12}Cl_2$, and the Fe containing clay, nontronite. A study of several Mg—Al hydrotalcites demonstrated a preference for crystallites less than about 300 Angstroms. Particularly novel are pillared varieties of smectites, kandites, LDHs and silicic acids in which the layered structure is pillared by oxides of Fe, Cr, Ni, Co, and Zn, or such oxides in combination with alumina as demonstrated by, but not limited to, U.S. Pat. No. 4,666,877, U.S. Pat. No. 5,326,734, U.S. Pat. No. 4,665,044/5 and Brindley et al., *Clays And Clay Minerals*, 26, 21 (1978) and *Amer. Mineral*, 64, 830 (1979), all incorporated herein by reference. The high molecular dispersions of the reactive metal make them very effective scavengers for sulfur bearing molecules.

A preferred class of hydrogen sulfide sorbents are those which are regenerable as contrasted to those which bind sulfur irreversibly in a stoichiometric reaction. Hydrogen sulfide sorbents which bind sulfur through physical adsorption are generally regenerable through manipulation of the process temperature, pressure, and/or gas rate so that the sorbent may cycle between adsorption and desorption stages. Representative of such sorbents are zeolitic materials, spinels, meso-. and microporous transition metal oxides, particularly oxides of the fourth period of the Periodic Chart of the Elements.

Hydrogen sulfide sorbents which bind sulfur through a chemisorptive mechanism may also be regenerated by the use of reactive agents through which the sulfur bearing compound is reacted and restored to its initial, active state. Reagents useful for the regeneration of these types of hydrogen sulfide sorbents are air (oxygen), steam, hydrogen, and reducing agents such as carbon and carbon monoxide. The choice of regenerating agent is determined by the initial, active state of the sorbent and by the chemical intermediates arising during the regeneration procedure. Active hydrogen sulfide sorbents regenerable by reaction with oxygen include the oxides of manganese, lanthanum, vanadium, tantalum, niobium, molybdenum, rhenium, zirconium, chromium, and mixtures thereof. Active hydrogen sulfide sorbents regenerable through reaction with steam, either alone or in combination with oxygen, include the oxides of lanthanum, iron, tin, zirconium, titanium, chromium, and mixtures thereof. Active hydrogen sulfide sorbents regenerable through the sequential action of hydrogen and oxygen include the oxides of iron, cobalt, nickel, copper, silver, tin, rhenium, molybdenum, and mixtures thereof. Active hydrogen sulfide sorbents regenerable through the action of hydrogen include iron, cobalt, nickel, copper, silver, mercury, tin, and mixtures thereof. In addition all transition metal oxides are regenerable from their corresponding sulfates by reduction with hydrogen, carbon, or carbon monoxide. These regeneration reactions may be facilitated by the inclusion of a catalytic agent that facilitates the oxidation or reduction reaction required to restore the sulfur sorbent to its initial, active condition.

In addition, of particular interest as regenerable hydrogen sulfide sorbents are two classes of materials: zeolitic materials enriched in the alkali metals of Group IA; the high surface area, porous materials represented by zeolite-like structures, nonstoichiometric basic oxides of the transition metals, reviewed in part by Wadsley (Nonstoichiometric Compounds, edited by Mandelkorn, Academic Press, 1964) and numerous surfactant templated metal oxide materials analogous to MCM-41 type structures as disclosed in U.S. Pat. No. 5,057,296 incorporated herein by reference.

These regeneration processes operate over a temperature range of 200–700° C., preferably 250–600° C., and more preferably 275–500° C. at pressures comparable to those cited below in the general disclosure of process conditions common to this invention.

The hydrodesulfurization catalyst and the hydrogen sulfide sorbent used in the practice of the present invention may be utilized in various bed configurations within the reactor. The choice of configuration may or may not be critical depending upon the objectives of the overall process, particularly when the process of the present invention is integrated with one or more subsequent processes, or when the objective of the overall process is to favor the selectivity of one aspect of product quality relative to another. For example, bed configuration, catalyst formulation and/or process conditions can be varied to control the level of concomitant aromatics saturation. Mixed bed configurations tend to increase aromatics saturation relative to their stacked bed counterparts. Also, higher metal loading, higher pressure and/or lower space velocity can lead to increased levels of aromatics saturation.

Various catalyst bed configurations may be used in the practice of the present invention with the understanding that the selection of a specific configuration is tied to specific process objectives. For example, bed configuration, catalyst formulation and/or process conditions can be varied to control the level of concomitant aromatics saturation. Mixed bed configurations tend to increase aromatics saturation relative to their stacked bed counterparts. Also, higher metal loading, higher pressure and/or lower space velocity can lead to increased levels of aromatics saturation. A bed configuration wherein the hydrogen sulfide sorbent is placed upstream of the HDS catalyst is not a configuration of the present invention.

Since the preferred HDS catalysts used in conjunction with the hydrogen sulfide sorbent can simultaneously provide an ASAT function in the systems described below, the HDS catalysts will hereafter be designated as HDS/ASAT catalysts. However, the HDS catalyst is not required to have an ASAT function.

Various catalyst bed configurations may be used in the practice of the present invention. As disclosed above, the same catalysts identified for HDS in this process will preferably also be active for ASAT. Bed configurations based on three components are disclosed below. One variation utilizes a mixed HDS/ASAT catalyst and hydrogen sulfide sorbent bed upstream of a stand-alone Ni-based hydrogenation catalyst; this generic arrangement is identified as the mixed/stacked configuration. The two beds could occupy a common reactor or separate reactors. Separate reactors would be preferred if it is advantageous to operate the stand-alone Ni-based hydrogenation catalyst at a substantially different temperature than the mixed bed of HDS/ASAT catalyst and hydrogen sulfide sorbent preceding it. The HDS/ASAT catalyst in the mixed bed and the stand-alone Ni-based hydrogenation catalyst may or may not be the same material.

A second variation is identified as the stacked/stacked/stacked configuration, where the three components are layered sequentially with a HDS/ASAT catalyst occupying the top position, the hydrogen sulfide sorbent the middle, and the stand-alone Ni-based hydrogenation catalyst the bottom zone. While the three component systems may occupy a common reactor, these systems may utilize a multi reactor train. One multi reactor configuration would have the HDS/ASAT catalyst and a hydrogen sulfide sorbent occupying the lead reactor and the stand-alone Ni-based hydrogenation catalyst occupying the tail reactor. Another multi-reactor configuration would have and HDS/ASAT catalyst occupying the lead reactor and the hydrogen sulfide sorbent followed by a Ni-based hydrogenation catalyst in the tail reactor. These arrangement permits operating the two reactor sections at different process conditions, especially temperature, and imparts flexibility in controlling process selectivity and/or product quality. Alternatively, each component could occupy separate reactors. This would allow process conditions for each component as well as facilitate frequent or continuous replacement of the hydrogen sulfide sorbent material. The HDS/ASAT catalyst and stand-alone Ni-based hydrogenation catalyst may or may not be the same material.

Noble metal catalysts can simultaneously provide HDS and ASAT functions. The ASAT activity of the catalyst can be maintained if said catalyst is intimately mixed with a hydrogen sulfide sorbent. The mixed bed configuration, as described above, allows operation in this mode. If this configuration is employed, the use of a stand-alone Ni-based hydrogenation catalyst after the mixed bed is optional, and said use would be dictated by specific process conditions and product quality objectives. If employed, the stand-alone Ni-based hydrogenation catalyst downstream may or may not be the same material as the HDS/ASAT catalyst used in the mixed bed. ASAT activity can also be maintained in a stacked bed configuration, but activity will generally be at a lower level than the mixed bed configuration.

Materials can also be formulated which allow one or more of the various catalytic functions of the instant invention (i.e., HDS, ASAT) and the hydrogen sulfide sorbent function to reside on a common particle. In one such formulation, the HDS/ASAT and hydrogen sulfide sorbent components are blended together to form a composite particle. For example, a finely divided, powdered Pt on alumina catalyst is uniformly blended with zinc oxide powder and the mixture formed into a common catalyst particle, or zinc oxide powder is incorporated into the alumina mull mix prior to extrusion, and Pt is impregnated onto the zinc oxide-containing alumina in a manner similar to that described in U.S. Pat. No. 4,963,249, which is incorporated herein by reference.

Another formulation is based on the impregnation of a support with a HDS/ASAT-active metal salt(s) (e.g., Pt, Pd, Ir, Rh) and a hydrogen sulfide sorbent-active salt (e.g., Zn) to prepare a polymetallic catalyst incorporating the HDS/ASAT metal(s) and the hydrogen sulfide sorbent on a common base. For example, a Pt-Zn bimetallic may be prepared in such a manner as to distribute both metals uniformly throughout the extrudate, or, alternatively, the Zn component may be deposited preferentially in the exterior region of the extrudate to produce a rim, or eggshell, Zn rich zone, or the Pt component may be deposited preferentially in the exterior region of the extrudate to produce a rim, or eggshell, Pt rich zone. These are often referred to as "cherry" structures.

In any of the configurations described above, the catalyst components may share similar or identical shapes and sizes, or the particles of one may differ in shape and/or size from the others. The later relationship is of potential value should it be desirable to affect a simple physical separation of the components upon discharge or reworking. Additionally, the hydrogen sulfide sorbent material can be sized to allow sorbent particles to flow through a fixed bed of any combination of catalysts moving with the liquid phase. In any of the stacked bed configurations wherein the hydrogen sulfide sorbent material is contained in a separate reactor, swing reactors can be employed such that one hydrogen sulfide sorbent reactor is always on-stream.

The composition of the sorbent bed is independent of configuration and may be varied with respect to the specific process, or integrated process, to which this invention is applied. In those instances where the capacity of the hydrogen sulfide sorbent is limiting, the composition of the sorbent bed must be consistent with the expected lifetime, or cycle, of the process. These parameters are in turn sensitive to the sulfur content of the feed being processed and to the degree of desulfurization desired. For these reasons, the composition of the guard bed is flexible and variable, and the optimal bed composition for one application may not serve an alternative application equally well. In general, the weight ratio of the hydrogen sulfide sorbent to the HDS/ASAT catalyst may range from 0.01 to 1000, preferably from 0.5 to 40, and more preferably from 0.7 to 30. For three component configurations the ranges cited apply to the mixed zone of the mixed/stacked arrangement and to the first two zones of the stacked/stacked/stacked design. The Ni-based hydrogenation catalyst present in the final zone of these two configurations is generally present at a weight equal to, or less than, the combined weight compositions of the upstream zones.

The process of this invention is operable over a range of conditions consistent with the intended objectives in terms of product quality improvement and consistent with any downstream process with which this invention is combined in either a common or sequential reactor assembly. It is understood that hydrogen is an essential component of the process and may be supplied pure or admixed with other passive or inert gases as is frequently the case in a refining or chemical processing environment. It is preferred that the hydrogen stream be sulfur free, or substantially sulfur free, and it is understood that the latter condition may be achieved if desired by conventional technologies currently utilized for this purpose. In general, the conditions of temperature and pressure are significantly mild relative to conventional hydroprocessing technology, especially with regard to the processing of streams containing the refractory sulfur types as herein previously defined. This invention is commonly operated at a temperature of 40–500° C. (104–932° F.) and preferably 225–400° C. (437–752° F.). Operating pressure includes 100–3000 psig, preferably 100–2,200 psig, and more preferably 100–1,000 psig at gas rates of 50–10,000 SCF/B (standard cubic feet per barrel), preferably 100–7,500 SCF/B, and more preferably 500–5,000 SCF/B. The feed rate may be varied over the range 0.1–100 LHSV (liquid hourly space velocity), preferably 0.3–40 LHSV, and more preferably 0.5–30 LHSV.

This invention is illustrated by, but not limited to, the following examples which are for illustrative purposes only.

EXAMPLE 1

In this example the feedstock was a blend of 10 volume percent of a high sulfur, high aromatic, solvent dewaxed raffinate and 90 volume percent of a 2,000 psig hydrotreated solvent dewaxed raffinate. The hydrotreated, solvent dewaxed raffinate (350N) had a density of about 0.867 g/cc at 15° C., a sulfur content of approximately 2.4 wppm, and an aromatic UV adsorption at 274 nm of approximately 27.2 in a 1 cm cell. The final blend was found to have an API gravity of about 34.1 and contained about 54 ppm sulfur with a UV absorbency at 274 nm of about 60.4 units. This feedstock was processed over a mixed bed composed of 4.0 cc (2.51 g) of a commercial 0.6 wt. % platinum on alumina reforming catalyst and 2.0 cc (1.52 g) of zinc oxide at a temperature between 276° C. and 349° C., a space velocity over the total catalyst charge of 1.0 LHSV, a pressure of 1,000 psig and treat gas rate of 2,500 SCF/B. The product was analyzed for aromatic content by UV spectroscopy and trace sulfur by the Houston-Atlas technique. The results are reported in Table I.

TABLE I

Sulfur and Aromatic Levels of A Solvent Dewaxed Raffinate Blend Are Decreased By Hydroprocessing Over Pt on Alumina/ZnO.

| Reaction Temperature (° C.) | UV @ 274 nm | Aromatic Reduction (%) | Sulfur (wppm) | Sulfur Reduction (%) |
|---|---|---|---|---|
| Feed Blend | 60.4 | — | 54 | — |
| 276 | 8.5 | 86 | 0.8 | 98.5 |
| 290 | 9.9 | 84 | 0.4 | 99.3 |
| 320 | 26.5 | 56 | 0.3 | 99.4 |
| 349 | 108.5 | [79] | <0.1 | >99.8 |

The mixed sulfur guard bed ($Pt/Al_2O_3$+ZnO) is highly effective at reducing sulfur content to less than 1 ppm. The sulfur reduction correlates with process severity, higher temperature being most effective at reducing sulfur. A reduction in sulfur greater than 99.8% is obtained at the highest temperature (349° C.). Aromatic saturation is also achieved over the mixed bed. Based on UV adsorption up to 86% aromatic reduction is obtained at 276° C.

EXAMPLE 2

In this example the feedstock was a hydrotreated solvent dewaxed raffinate (350N) having density of about 0.867 g/cc at 15° C., a sulfur content of approximately 2.4 wppm, and an aromatic UV adsorption at 274 nm of approximately 27.2 in a 1 cm cell. This feedstock was reacted over a mixed sulfur guard bed composed of 7.5 cc (4.29 g) of a commercial 0.6 wt. % Pt on alumina reforming catalyst and 7.5 cc (5.84 g) of zinc oxide at a temperature between 275° C. and 350° C., a space velocity over the total catalyst charge of 1.0 to 4.0 LHSV, a pressure of 1,000 psig and a treat gas rate of 2,500 SCF/B. The effluent product was analyzed for aromatic content by UV spectroscopy at 274 nm and trace sulfur by Houston-Atlas technique. The results shown in Table II below.

TABLE II

Sulfur and Aromatic Levels of A Hydrotreated Solvent Dewaxed Raffinate Are Decreased by Hydroprocessing Over Pt on alumina/ZnO

| Reaction Temperature (° C.) | LHSV | UV @ 274 nm | Aromatic Reduction (%) | Sulfur (wppm) | Sulfur Reduction (%) |
|---|---|---|---|---|---|
| Feed | — | 27.2 | — | 2.4 | — |
| 200 | 1.0 | 5.3 | 81 | 1.1 | 54 |
| 200 | 2.0 | 9.6 | 65 | 1.3 | 46 |
| 200 | 4.0 | 15.4 | 43 | 1.3 | 46 |
| 250 | 2.0 | 7.5 | 72 | 1.2 | 50 |
| 250 | 4.0 | 11.0 | 60 | 1.3 | 46 |

The mixed bed of $Pt/Al_2O_3$ and ZnO is highly effective at reducing sulfur at temperatures conventionally used for white oil hydrogenation when using a Ni based catalyst. The sulfur guard bed exhibits comparable sulfur reduction efficiency, around 50% sulfur reduction, when operating between 200 and 250° C. and LSHV between 1 and 4. Aromatic reduction is extremely high at about 80% at 200° C. and LHSV of 1. Such sulfur and aromatic reduction at white oil hydrogenation conditions makes the sulfur guard bed attractive.

EXAMPLE 3

In this example the feedstock was the same as in Example 2. The 15 cc (7.7 g) catalyst charge used in this example is a commercial pre-reduced nickel based hydrogenation catalyst. The catalyst was evaluated as a hydrogenation catalyst at a temperature of 200° C., a pressure of 1,000 psig and treat gas rate of 2,500 SCF/B, a space velocity of 1.0 LHSV. The hydrogenation catalyst activity maintenance was studied by measuring the effluent UV aromatic adsorption at 274 nm as a function of time on oil. Example 3 will be used as the reference for the Ni hydrogenation catalyst deactivation. The results of this experiment are shown in Table III.

TABLE III

Sulfur Guard Bed Protects Ni Hydrogenation Catalyst From Deactivation

| | LHSV | First Deactivation Rate (UV unit/hour) | Length (hour) | Second Deactivation Rate (UV unit/hour) |
|---|---|---|---|---|
| Example 3 | 1.0 | 0.051 | 75 | 0.019 |
| Example 4 | 1.0 | 0.023 | 120 | 0.014 |
| Example 5 | 0.5 | 0.012 | — | none |
| | 1.0 | 0.011 | — | none |
| | 2.0 | 0.011 | — | none |
| Example 6 | 1.0 | 0.012 | — | none |
| | 2.0 | 0.014 | — | none |

Two deactivation rates were observed for the Ni hydrogenation catalyst. The first deactivation rate was observed over the first 75 hours on oil and found to have a value of about 0.051 UV unit/hour. The second deactivation rate, observed after 75 hours on oil, was found to be less than half that of the first deactivation rate, with a value of about 0.019 UV unit/hour. With heterogeneous catalysts, it is not uncommon to observe two deactivation rates. The first deactivation rate is higher than the second due to phenomenon such as selective poisoning of the most active sites and de-edging of the catalyst.

EXAMPLE 4

A catalyst charge was prepared in which 15 cc (8.04 g) of the commercial pre-reduced nickel based hydrogenation catalyst described in example 3 was admixed with 30 cc (24.0 g) of zinc oxide. This system was evaluated for aromatic hydrogenation of the feed described in Example 2. The hydrogenation catalyst activity maintenance was studied at a temperature of 200° C., a pressure of 1,000 psig and a treat gas rate of 2,500 SCF/B, and a space velocity over the nickel based catalyst of 1.0 LHSV by measuring the effluent UV aromatic adsorption at 274 nm as a function of time on oil. The results of this experiment are shown in Table III.

Admixing the hydrogen sulfide sorbent (i.e., ZnO) with the Ni hydrogenation catalyst was beneficial. Two deactivation rates were also observed for this system. The first deactivation rate was observed over a period of 120 hours on oil at a value of about 0.023 UV unit/hour. Comparison with Example 3 reveals an improvement in the hydrogenation activity maintenance by exhibiting a lower deactivation rate in the presence of the hydrogen sulfide sorbent.

EXAMPLE 5

In this example the feedstock was the same as in Example 2. A mixed bed was prepared in which 7.5 cc (4.60 g) of a commercial 0.6 wt. % Pt on alumina reforming catalyst was admixed with 7.5 cc (5.94 g) zinc oxide. Downstream of this mixture was placed 15 cc (7.83 g) of the same hydrogenation catalyst of Example 3; the overall configuration is a mixed/stacked bed configuration with the two zones separated by mullite beads. The hydrogenation catalyst activity maintenance was studied at a temperature of 200° C., a pressure of 1,000 psig, treat gas rate of 2,500 SCF/B, and a space velocity over the hydrogenation catalyst of 0.5 to 2.0 LHSV by measuring the effluent UV aromatic adsorption at 274 nm as a function of time on oil. The results of this experiment are reported in Table III.

Only one deactivation rate is observed over this mixed/stacked bed configuration. This single deactivation rate (0.011 UV unit/hour) is significantly lower than that observed over the Ni hydrogenation catalyst alone (example 3) or over the Ni catalyst admixed with the hydrogen sulfide sorbent (example 4). A decrease in the deactivation rate using the mixed guard bed upstream of the Ni hydrogenation catalyst translates to a significant increase in the Ni catalyst life time.

EXAMPLE 6

In this example the feedstock was the same as in Example 2. The hydrotreated solvent dewaxed raffinate feedstock was reacted over a stacked/stacked/stacked catalyst bed configuration in which each zone was separated by mullite beads. The composition and sequence was as follows: (a) first zone, 7.5 cc (4.76 g) of a reduced, sulfided 0.6 wt. % Pt on alumina catalyst; (b) a second zone, 7.5 cc (5.92 g) of zinc oxide; and (c) a third zone downstream of zone (b), 15.0 cc (7.58 g) of the same pre-reduced nickel based hydrogenation catalyst used in Example 3. This catalytic system was evaluated at a temperature of 200° C., a pressure of 1,000 psig, treat gas rate of 2,500 SCF/B, a space velocity over the nickel-based hydrogenation catalyst of 1.0 to 2.0 LHSV. The hydrogenation activity was measured as a function of time by measuring the effluent UV aromatic adsorption at 274 nm as a function of time on oil. The results of this experiment are reported in Table III. The results of Example 6 indicates that the three zone stacked/stacked/stacked catalytic configuration is equally effective at reducing deactivation of the nickel-based hydrogenation catalyst at the mixed/stacked configuration of example 5.

What is claimed is:

1. A process for the preparation of pharmaceutical grad white oils from a feedstock, by a three stage catalytic process, which process comprises: (a) hydrotreating said feedstock in a first reaction stage containing a hydrotreating catalyst and a hydrogen-containing treat gas, which first reaction stage is operated under hydrotreating conditions, thereby resulting in said feedstock being at least partially hydrogenated and desulfurized, wherein the feedstock is a raffinate derived from a solvent treatment of a light or medium neutral distillate oil of lubricating viscosity, the raffinate having a viscosity ranging from about 70 to about 500 SUS at 37.8° C.; (b) hydrotreating the reaction product of said first reaction stage in a second reaction stage in the presence of: (i) a hydrodesulfurization catalyst comprised of a Group VIII metal on an inorganic support, (ii) a hydrogen-containing treat gas, and (iii) a hydrogen sulfide sorbent material, wherein said second reaction stage is operated at temperatures from about 40° C. to 500° C. and pressures from about 100 to 3,000 psig; and (c) hydrogenating the reaction product from said second reaction stage in a third reaction stage in the presence of a nickel based catalyst, thereby producing a white oil.

2. The process of claim 1 wherein the Group VIII metal is a noble metal is selected from Pt, Pd, Ir, and polymetallics thereof.

3. The process of claim 2 wherein the noble metal is selected from Pt, Pd, and polymetallics thereof.

4. The process of claim 2 wherein the hydrodesulfurization catalyst and the hydrogen sulfide sorbent are present in a single mixed bed.

5. The process of claim 2 wherein the hydrogen sulfide sorbent material is selected from supported and unsupported metal oxides, spinels, zeolitic based materials, and hydrotalcites.

6. The process of claim 2 wherein the hydrodesulfurization catalyst is promoted with one or more metals selected from the group consisting of Re, Cu, Ag, Au, Sn, Mn, and Zn.

7. The process of claim 1 wherein the concentration of noble metal is from about 0.01 to 3 wt. %, based on the total weight of the catalyst.

8. The process of claim 2 wherein the inorganic refractory support is selected from the group consisting of oxides of Al, Si, Mg, B, Ti, Zr, P, and mixtures and cogels thereof.

9. The process of claim 2 wherein the inorganic refractory support is selected from clays and zeolitic materials and mixtures thereof.

10. The process of claim 9 where the zeolite is enriched with one or more metals of Group Ia of the Periodic Table of the Elements.

11. The process of claim 2 wherein the hydrogen sulfide sorbent is a metal oxide of metals from Groups IA, IIA, IB, IIB, IIIA, IVA, VB, VIB, VIIB, and VIII of the Periodic Table of the Elements.

12. The process of claim 11 wherein the metal is selected from the group consisting of K, Ba, Ca, Zn, Co, Ni, and Cu.

13. The process of claim 2 wherein the non-noble metal is Ni.

14. The process of claim 2 wherein the hydrodesulfurization catalyst and the hydrogen sulfide sorbent material are composited into single particles.

15. The process of claim 2 wherein the hydrodesulfurization metal and the metal of the hydrogen sulfide sorbent are precipitated on the same support material.

16. The process of claim 2 wherein said hydrogen sulfide sorbent flows through a bed of said noble metal catalyst with the feedstream.

17. The process of claim 2 wherein the pressure is from about 100 to 1,000 psig.

* * * * *